United States Patent [19]

Mangus

[11] 4,312,184

[45] Jan. 26, 1982

[54] FLUID CIRCULATION SYSTEM FOR HEAT EXCHANGERS

[75] Inventor: James D. Mangus, Greensburg, Pa.

[73] Assignee: Westinghouse Electric Corp., Pittsburgh, Pa.

[21] Appl. No.: 850,441

[22] Filed: Nov. 10, 1977

Related U.S. Application Data

[63] Continuation of Ser. No. 603,076, Aug. 8, 1975, now Defensive Publication No. T954,001.

[51] Int. Cl.[3] ..... F28D 15/00

[52] U.S. Cl. ..... 60/644.1; 165/140; 165/104.31; 165/104.34; 376/250; 376/277; 376/402

[58] Field of Search ..... 165/140, 104 R; 60/644; 176/38, 65

[56] References Cited

U.S. PATENT DOCUMENTS

| | | | |
|---|---|---|---|
| 2,936,159 | 5/1960 | Boni Jr. | 165/140 X |
| 3,670,522 | 6/1972 | Bresin | 165/140 X |
| 3,968,653 | 7/1976 | Cachera | 60/644 |

FOREIGN PATENT DOCUMENTS

| | | | |
|---|---|---|---|
| 18191 | 11/1955 | Fed. Rep. of Germany | 165/140 |
| 178579 | 3/1962 | Sweden | 165/140 |
| 1193609 | 6/1970 | United Kingdom | 60/644 |

*Primary Examiner*—Albert W. Davis
*Attorney, Agent, or Firm*—M. S. Yatsko; E. L. Levine; Z. L. Dermer

[57] ABSTRACT

A fluid circulation system for heat exchangers having two groups of tubes through which primary and secondary fluids flow, the tubes of one group being interdigitated with the tubes of the other group, and a heat transfer material interposed between the two groups of tubes, whereby heat is transferred from the primary fluid through the heat transfer material to the secondary fluid. A shell forms a closure around the tubes and the heat transfer material, and the shell has tertiary fluid inlet and outlet means. Openings in the heat transfer material form passageways through which the tertiary fluid can flow from the inlet means, through the heat exchanger, to the outlet means. Piping connects the tertiary fluid outlet means to the tertiary fluid inlet means, forming a complete cycle. Installed in this piping is a heat removal system. If the secondary fluid flow is interrupted, the tertiary fluid provides a redundant means by which the heat of the primary fluid can be removed from the heat exchanger. Monitoring means can be inserted into the piping, to detect any leakages which may occur in the primary and secondary tubes. Condensers or desiccating material can be installed in the heat removal means to remove any liquids which may leak into the tertiary fluid. Additionally, if the tertiary fluid is a gas or vapor, a turbine can be inserted into the piping and the tertiary fluid's power utilized to provide energy to power the compressor or pump which is circulating the tertiary fluid. In an emergency, this turbine can be connected to an electrical generator and provide emergency power to the rest of the plant.

9 Claims, 8 Drawing Figures

FLUID CIRCULATION SYSTEM FOR HEAT EXCHANGERS

This is a continuation of application Ser. No. 603,076, filed Aug. 8, 1975, now Defensive Publication No. T954,001, filed Jan. 4, 1977.

BACKGROUND OF THE INVENTION

This invention relates to a fluid circulation system for heat exchangers, and more particularly to a redundant heat removal system for heat exchangers used in nuclear reactor systems.

The nuclear reactor produces heat by fissioning of nuclear materials which are fabricated into fuel elements and assembled within a nuclear core. In commercial nuclear reactors, the heat produced thereby is used to generate electricity.

In a liquid cooled nuclear reactor, such as a liquid metal cooled breeder reactor, reactor coolant, such as liquid sodium, is circulated through the primary coolant flow system. A typical primary system coolant flow loop comprises a nuclear core within a reactor vessel, a heat exchanger, a circulating pump, and piping interconnecting the aforementioned apparatus. In nuclear reactors having more than one primary system coolant flow loop, the nuclear core and the reactor vessel are common to each of the primary system flow loops.

The heat generated by the nuclear core is removed by the reactor coolant which flows into the reactor vessel and through the nuclear core. The heated reactor coolant then exits from the reactor vessel and flows to the heat exchanger, where it transfers its heat to a flow system associated therewith. If the nuclear reactor system is of the direct type, this flow system coolant is water, which is transformed into steam as it passes through the heat exchanger, and is connected to turbines and electrical generators.

If the nuclear reactor system includes an intermediate coolant flow loop, the intermediate coolant, which may be a liquid metal or a liquid organic fluid, is heated, and flows to a second heat exchanger where its heat is transferred to a fluid of a secondary coolant flow loop. The secondary coolant would be water transformed into steam, and coupled to steam turbines and electrical generators.

In the nuclear reactor field, safety considerations mandate that redundant means be provided for removal of heat produced in the core in the unlikely event of a secondary coolant system failure, or for standby operations during which the secondary coolant system is not operating. In the prior art, these redundant means have taken two forms.

The first method was to provide an additional coolant flow loop to the nuclear core. In the event one of the coolant flow loops failed, this additional loop would become operable and would circulate hot reactor coolant through its system. Although this system provided a redundant means, it was economically unfeasible. The physical size of this additional heat removal system was comparable to the main heat transport loops, but it did not contribute to the plant power generation capability.

The second method used in the prior art was to make use of the main heat transport system for heat removal to a redundant water system through the steam generators. As such, it requires that the normal heat transfer systems be operable in an emergency condition. It also requires that redundancy be provided in the secondary coolant flow system, that a third loop be installed in the heat exchangers, and that a class I supply of water be stored within the plant. Although this method is also quite expensive, it is probably less expensive than that incurred with the first method. A second problem with this method, however, is that the operation of the plant for emergency or decay heat, removal operation is quite complicated, requiring large condenser flows, blow-off systems, and recirculating water systems.

SUMMARY OF THE INVENTION

The aforementioned problems of the prior art are eliminated by this invention by providing a redundant means for heat removal utilizing the heat exchangers, without requiring a separate third coolant system loop in the heat exchangers, or the necessity of storing a class I supply of water. A tertiary fluid circulates through the heat exchanger in passageways provided in the heat transfer material, gathering heat during emergency or standby operations, and then a heat removal system is utilized to cool this tertiary fluid before it recirculates through the heat exchanger. If the heated tertiary fluid is a gas or vapor, then by flowing through a turbine, energy may be extracted from the tertiary fluid, and this energy may be utilized to provide power to the means for circulating the tertiary fluid. If the fluid is a liquid, sufficient natural circulation by thermal density differences may eliminate the necessity for a pumping requirement. Additionally, this tertiary fluid may be monitored to detect leaks in the main heat exchanger tubes. This tertiary fluid can also be utilized to remove any liquid which may be leaking from one of the heat exchanger tubes.

BRIEF DESCRIPTION OF THE DRAWINGS

Reference is now made to the description of the preferred embodiment, taken in connection with the accompanying drawings, in which.

DESCRIPTION OF THE PREFERRED EMBODIMENT

Figure 1:
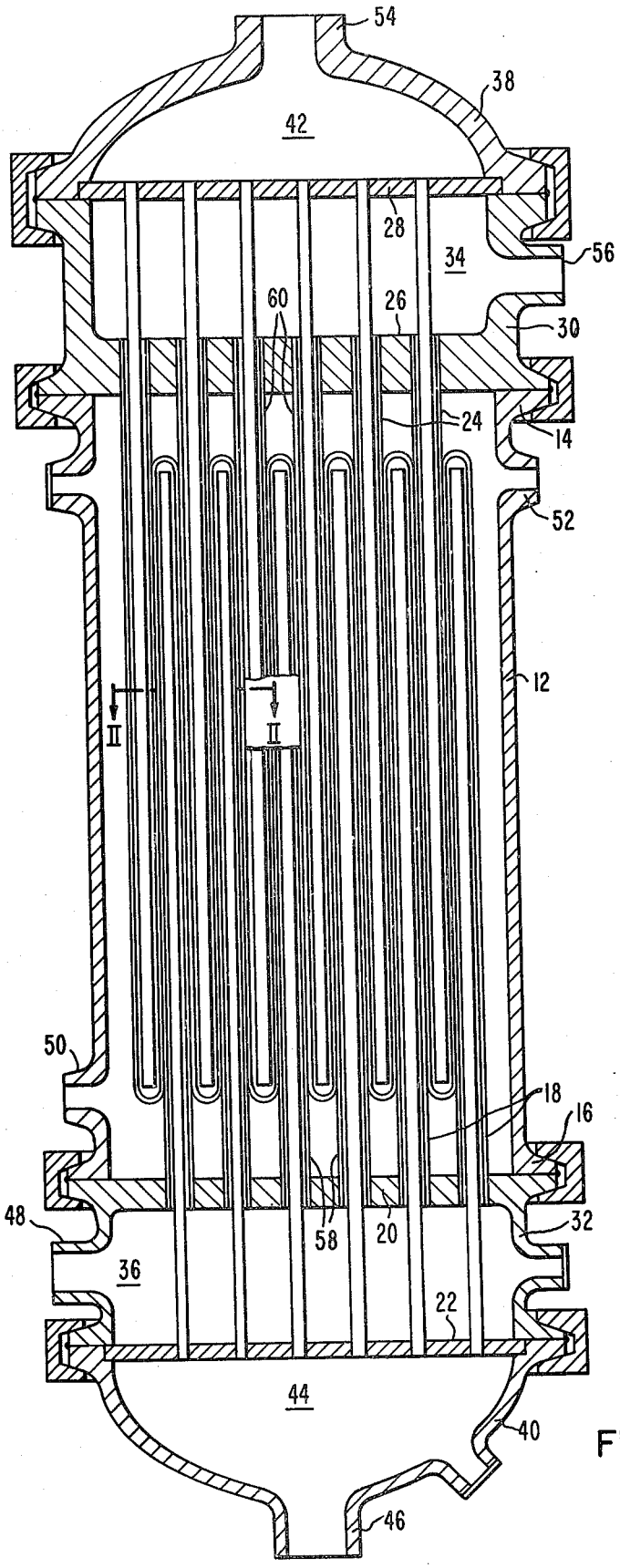
FIG. 1 is a vertical sectional view of a heat exchanger which may utilize this invention.

Throughout the description which follows, like reference characters indicate like elements in the various figures of the drawings.

FIG. 1, illustrating a typical heat exchanger in which this invention may be practiced, shows a heat exchanger comprising a vertical, tubular or cylindrically shaped shell portion 12 having upper end flanges 14 and lower end flanges 16. Within the shell are a first group of tubes or a tube bundle 18, which extend upwardly from a first lower tube sheet 20 and a second lower tube sheet 22 and a second group of tubes or a tube bundle 24 which depend from a first and second upper tube sheet 26 and 28, respectively. The tube sheets 26 and 28, and 20 and 22, are separated by upper and lower tubular or cylindrical members 30 and 32, respectively, which cooperate with the tube sheet to form fluid outlet chambers 34 and 36. Flanged 38 and dished 40 heads are disposed to form enclosures for the steam generator and cooperate with the tube sheets 22 and 28 to form inlet chambers 42 and 44.

A primary fluid inlet nozzle 46, for a primary fluid such as liquid sodium, is centrally disposed in the lower head 40 and a primary fluid outlet nozzle 48 is disposed in the lower tubular member 32. Tertiary fluid inlet means 50 and tertiary fluid outlet means 52 are disposed from the shell portion 12.

A secondary fluid inlet nozzle 54, for a secondary fluid such as water or, in the case of an intermediate coolant flow system, such as liquid sodium, is centrally disposed in the upper head 38, and a secondary fluid outlet nozzle 56, for a fluid such as liquid sodium or steam, is disposed in the upper tubular member 30.

The primary fluid tubes 58 and the secondary fluid tubes 60 are interdigitated. The voids between the primary fluid tubes 58 and the secondary fluid tubes 60 are filled with a heat transfer material 62, as shown in FIG. 2, to assist in transferring heat from one group of tubes 18 to the other group of tubes 24.

Figure 2:
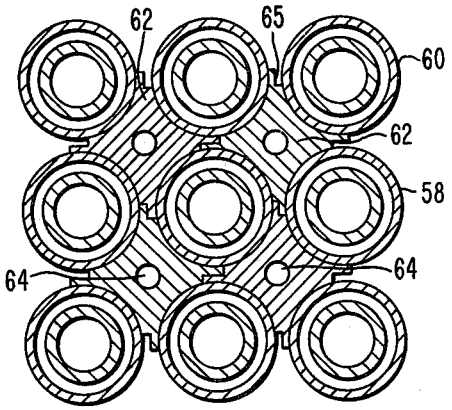
FIG. 2 is an enlarged partial sectional view taken on line II—II of FIG. 1.

The heat transfer material 62 may take several forms, as shown in FIGS. 1 and 2. The heat transfer material 62 may be metallic strips 62, which generally extend the length of the interdigitating portions of the primary and secondary tubes, 58 and 60, respectively, and generally have a cruciform shaped cross-section. The strips 62 have centrally disposed openings 64 disposed therethrough. These openings 64, and the annular spaces 65 between the tubes 58 and 60 and the metallic strips 62 form passageways for the tertiary fluid to flow from the tertiary fluid inlet means 50 through the heat transfer material 62, and to the tertiary fluid outlet means 52.

Figure 3:
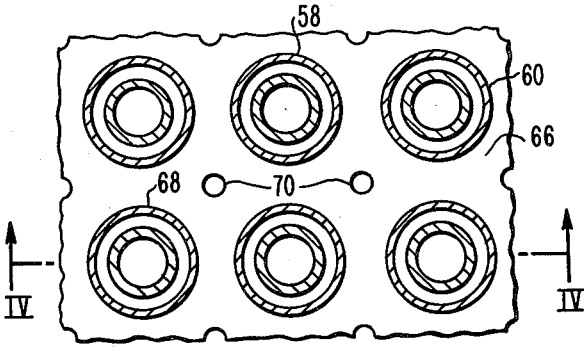
FIG. 3 is a modification of the partial sectional view shown in FIG. 2.
Figure 4:
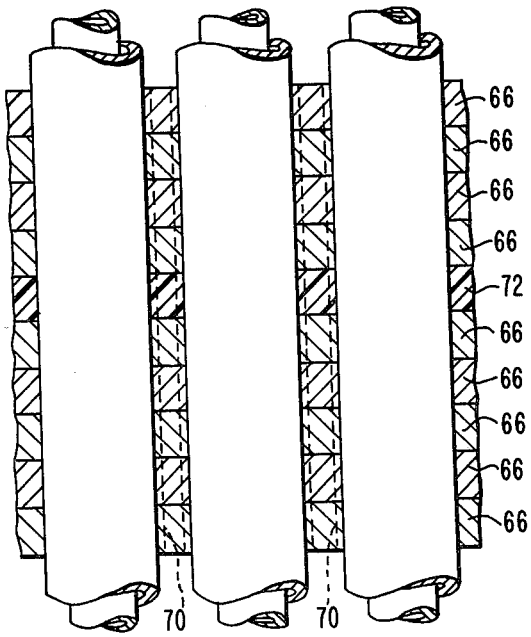
FIG. 4 is a partial sectional view taken on line IV—IV of FIG. 3.

As shown in FIGS. 3 and 4, the heat transfer material may comprise a plurality of plates 66. The plates 66 have holes 68 therethrough for receiving the tubes 58 and 60, and a plurality of holes 70 for the passage of the tertiary fluid. The plates 66 may be stacked adjacent each other and groups of the plates 66 may be separated by insulating plates or pad 72.

Figure 5:
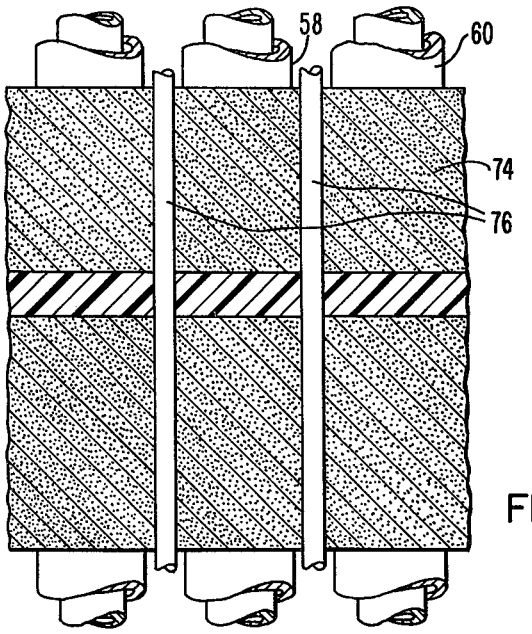
FIGS. 5 and 6 are modifications of the partial sectional view shown in FIG. 4.

As shown in FIG. 5, the heat transfer material may be particulate matter 74, and, depending on the size of the particles and the density to which they are packed, the space between particles may be sufficient to allow the tertiary fluid to flow from the tertiary fluid inlet means 50 through the particulate matter 74 to the tertiary fluid outlet means 52. Tubes 76 may be inserted into the particulate matter 74 to facilitate the flow of the tertiary fluid therethrough.

Figure 6:
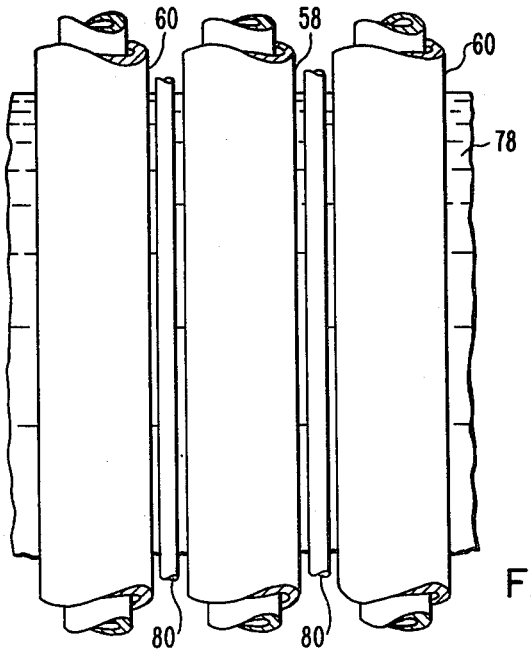

As shown in FIG. 6, the heat transfer material filling the voids may be a liquid 78. Tubes 80 may be inserted into the liquid 78 to facilitate the flow of the tertiary fluid from the tertiary fluid inlet means 50 through the liquid heat transfer material 78 and to the tertiary fluid outlet means 52.

For a more detailed description of the above mentioned heat exchanger, reference is made to my copending application "Double Tube Heat Exchanger," Ser. No. 390,282, filed Aug. 21, 1973, now U.S. Pat. No. 3,907,026.

As can be appreciated by one skilled in the art, various types of heat exchangers, utilizing numerous configurations of tubes and heat transfer material, can employ the principles of this invention. The requisites necessary for utilizing this invention are the use of a heat transfer material to transfer the heat from a primary coolant to a second coolant, inlet and outlet means for the tertiary fluid disposed in the container, and passageways through which the tertiary fluid can flow from the inlet means to the outlet means. Although this description refers to liquid metal cooled nuclear reactors, the invention is equally applicable to pressurized water reactors, high temperature gas reactors, or to any application where it may be desirable to provide a redundant means of heat removal in the event of a failure of the secondary coolant system.

Figure 7:
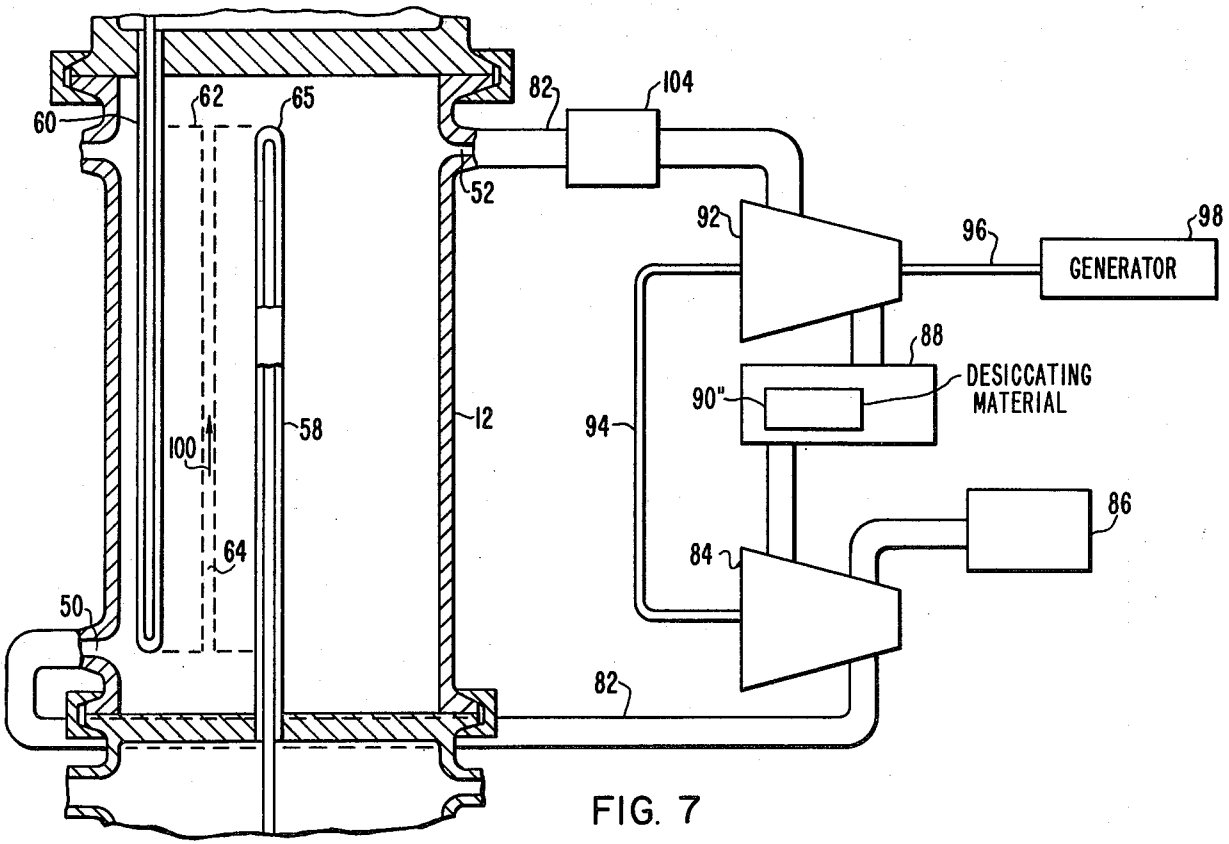
FIG. 7 is a schematic of the tertiary fluid circulation system.

FIG. 7 illustrates the tertiary fluid circulation system for use when the tertiary fluid is an inert gas such as helium. The heat exchanger shown is that of the direct type; that is, the fluid in the primary tube 58 is a liquid metal such as liquid sodium, and the fluid in the secondary tube 60 is water, either in the liquid or gaseous state. The heat conducting material 62 is cruciform strips, having openings 64 disposed therethrough, and annular spaces 65 between the strips 62 and the tubes 58, 60 forming passageways from the tertiary fluid inlet means 50 through the heat conducting material 62 to the tertiary fluid outlet means 52.

Piping 82 connects the tertiary fluid outlet means 52 to the tertiary fluid inlet means 50 of the heat exchanger. Inserted into this piping 82 are means 84 for circulating the tertiary fluid, such as a compressor or a gas pump. An inert gas source 86 is connected to the circulating means 84. Means 88 for removing heat from the tertiary fluid are located in the piping 82. The heat removal means 88 may be a conventional gas to air heat exchanger, or, if so desired, may be a heat exchanger wherein the heat from the tertiary fluid is transferred to another system which, for example, supplies heat to a steam superheater (not shown).

To enhance operability of the heat exchange system in the unlikely event of a leak developing in a secondary fluid tube 60, through which water could leak into the inert gas, means 90 for removing water from the inert gas may be installed into the heat removal system 88. These water removal means 90 may be a condenser 90' or desiccating material 90".

A turbine 92 may be installed in the piping 82. This turbine 92 is powered by the hot inert gas flowing through it. The turbine 92 may be connected to the circulating means 84 by means 94. In this arrangement, the energy produced in the turbine 92 by the inert gas flowing through it is utilized to power the circulating means 84 which are used to circulate the inert gas. If the temperature of the inert gas is high enough, the energy produced by the turbine 92 may be enough to operate the circulating means 84 without need of any external power source. If the energy produced is not sufficient to operate the circulating means 84 alone, a system may be utilized in which the turbine 92 supplies part of the energy necessary to run the circulating means 84, and an external source (not shown) would supply the remaining required power. Additionally, the turbine 92 can be connected by means 96 to a motor-generator 98. In this arrangement, the turbine 92 would not only supply power to the circulating means 84, but also could produce useful energy in the motor-generator 98, which may be desirable during emergency conditions.

During normal heat exchange operations, the inert gas in the tertiary fluid circulation system is generally stagnant. During emergency conditions, or standby operations where it is not desirable to operate the secondary fluid system, the tertiary fluid circulation system is utilized to remove the heat from the primary fluid. The inert gas enters into the circulating means 84, passes through the piping 82 and passes through the shell 12 of the heat exchanger through the tertiary fluid inlet means 50. The inert gas then flows along the line designated by the arrow 100, through the passageway 64 in the heat conducting means 62. As it flows through the passageway 64, the inert gas is heated by the heat contained in the primary fluid flowing in the primary fluid tube 58 and conveyed by the heat conducting means 62. The heated gas then flows out of the shell 12 through the tertiary fluid outlet means 52 into the piping 82. The hot gas is then passed through the turbine 92 and flows to the heat removal system 88. In the heat removal system 88, the inert gas is cooled, any water present in the inert gas is removed by the liquid removal means 90, and the gas is returned to the circulating means 84. The energy produced by the turbine 92 is supplied to the circulating means 84, and, if the gas is hot enough, useful energy is produced in the motor-generator 98. During this heat removal process, the inert gas is circulated at a relatively low pressure, approximately 150–300 lbs. per square inch.

FIG. 7 also illustrates another function of this tertiary fluid circulation system, one which may be utilized during normal operations. The aforementioned elements of the circulation system; the heat removal means 88, the liquid removal means 90, circulating means 84, the turbine 92, and the motor-generator 98, are all present. Additionally, means for detecting radioactivity 104 are inserted into the piping 82. The inert gas is circulated as described above, but at a lower pressure of approximately 100 lbs. per square inch. As the inert gas passes through the piping 82 it flows through the radiation detection means 104, such as a gamma counter. This gamma counter 104 measures the amount of radioactivity present in the inert gas. By so doing, it is possible to determine if there is a leak in a primary fluid tube 58.

Another function which may be utilized during normal operations is the removal of tritium. In addition to the inert gas, a quantity of oxygen is added to the tertiary fluid. As the tertiary fluid flows through the circulation system, the oxygen reacts with any tritium which may be present. The reaction product of the oxygen and the tritium is then removed through the liquid removal system 90 and the heat removal system 88.

Hydrogen can be added to the inert gas in the tertiary fluid circulation system. In this function, the pressure of the inert gas would be maintained at a pressure greater than the pressure of the fluid in the primary fluid system. In the event of a leak in a primary tube 58, the hydrogen in the inert gas would flow through the leak in the tube 58, and could be detected elsewhere in the primary fluid system (not shown).

As can be appreciated by one skilled in the art, any or all of the aforementioned elements can be included in the tertiary fluid circulation system, depending upon the desires of the designer. Also, the various elements can be serially connected, or can be equipped with bypass flow means.

An inert liquid, for example, lead-bismuth, can be used in the tertiary fluid circulation system instead of the inert gas. During normal operations the lead-bismuth is stagnant, and improves the heat conductivity between the tubes 58, 60, and the heat conducting strips 62. This inert liquid would function the same as the inert gas for the heat removal function, excepting the creation of power in the turbine 92 (FIG. 7). However, the heat removal system 88 can be designed to utilize the heat removed from the inert liquid. The circulating means 84 in this instance would be a liquid pump, or natural circulation may provide the heat removal 88.

Figure 8:
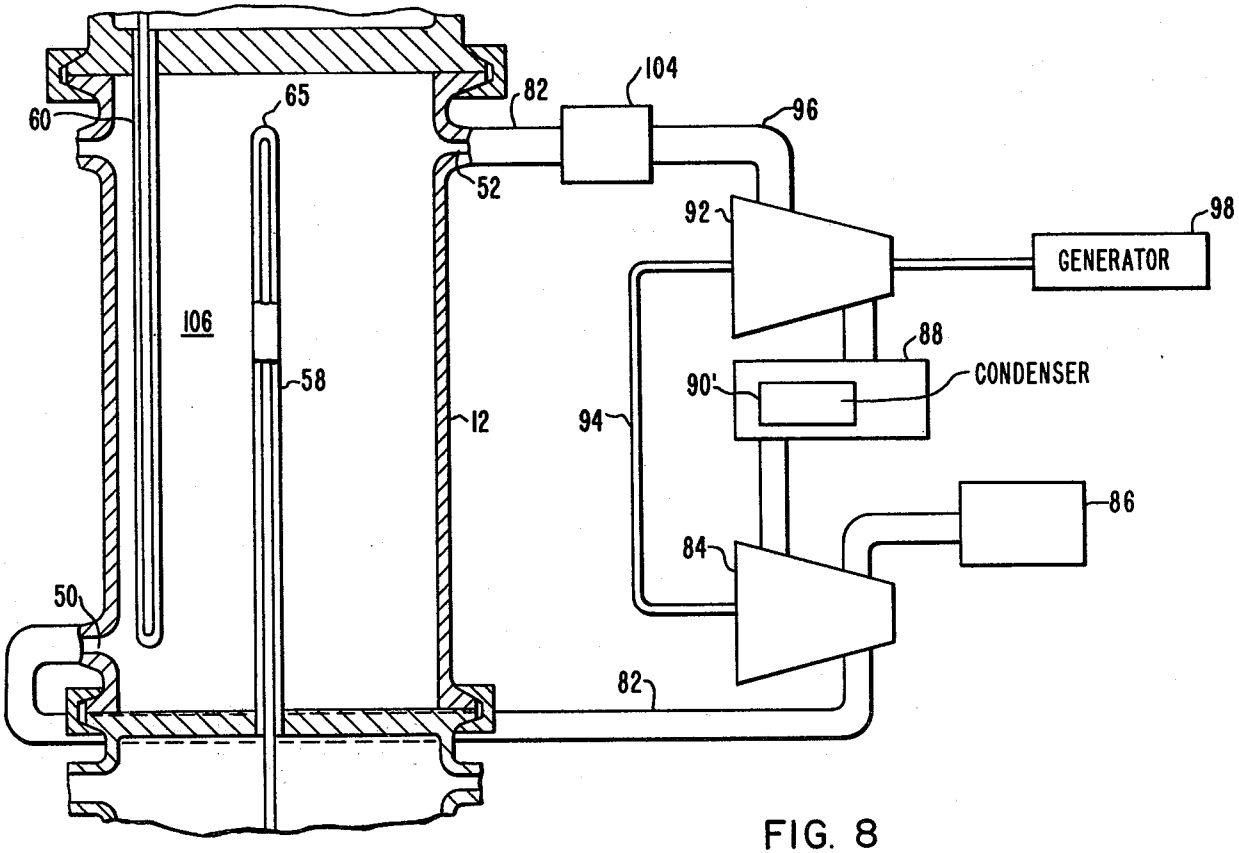
FIG. 8 is a modification of the system shown in FIG. 7.

Another modification of this invention is illustrated in FIG. 8. The tertiary fluid in this modification is an inert gas, and this inert gas also functions as the heat conducting means. In this instance, the passageways from the tertiary fluid inlet means 50 to the tertiary fluid outlet means 52 are the spaces 106 inside the shell 12 between the primary tubes 58 and the secondary tubes 60. This modification operates as previously described during periods when the secondary fluid is not flowing. During normal operations, the heat from the primary fluid and the primary tubes 58 is transferred to the fluid in the secondary tube 60 through the inert gas.

This modification does not provide for physical separation of the fluids in the event of a leak from both the primary tube 58 and the secondary tube 60. However, this modification may be desirable when the physical separation of the primary and secondary fluids is not critical.

Thus, it can be seen that this invention provides a redundant means of removing heat from a primary fluid without the necessity of installing an additional coolant loop into the heat exchanger.

I claim as my invention:

1. A nuclear reactor including a tertiary fluid and a tertiary fluid circulation system for heat exchangers having a shell portion, a first group of tubes through which a primary fluid flows, a second group of tubes through which a secondary fluid flows, said first and second groups of tubes being so positioned that a tube of one group is positioned between a plurality of tubes in the other group, and means for conducting heat positioned between said tubes, whereby a portion of the heat energy in the fluid in one group of tubes is transferred through said means for conducting heat to the fluid in the other group of tubes, said tertiary fluid circulation system comprising:

said shell having tertiary fluid inlet means and tertiary fluid outlet means;

said means for conducting heat having passageways from said tertiary fluid inlet means to said tertiary fluid outlet means;

means for connecting said tertiary fluid outlet means and said tertiary fluid inlet means, said connecting means including structure for removing heat from said tertiary fluid; and means for circulating a tertiary fluid from said tertiary fluid inlet means, through said passageways in said means for conducting heat, through said tertiary fluid outlet means, through said means for connecting said tertiary fluid outlet means and said tertiary fluid inlet means, and to said tertiary fluid inlet means.

2. The system according to claim 1 wherein said tertiary fluid is an inert liquid.

3. The system according to claim 2 wherein said inert liquid is lead-bismuth.

4. A tertiary fluid circulation system for heat exchangers having a shell portion, a first group of tubes through which a primary fluid flows, a second group of tubes through which a secondary fluid flows, said first and second groups of tubes being so positioned that a tube of one group is positioned between a plurality of tubes in the other group, and means for conducting heat positioned between said tubes, whereby a portion of the heat energy in the fluid in one group of tubes is transferred through said means for conducting heat to the fluid in the other group of tubes, said tertiary fluid circulation system comprising:

said shell having tertiary fluid inlet means and tertiary fluid outlet means;

said means for conducting heat having passageways from said tertiary fluid inlet means to said tertiary fluid outlet means; and means for circulating a tertiary fluid, said tertiary fluid comprising an inert gas, from said tertiary fluid inlet means, through said passageways in said means for conducting heat, through said tertiary fluid outlet means, through means for connecting said tertiary fluid outlet means and said tertiary fluid inlet means, said connecting means including structure for removing liquid which may be present in said inert gas and structure for removing heat from said inert gas, and from said connecting means back to said tertiary fluid inlet means.

5. The system according to claim 4 wherein said structure for removing liquid present in said inert gas is a condenser included in said structure for removing heat.

6. The system according to claim 4 wherein said structure for removing liquid present in said inert gas is a desiccating material included in said structure for removing heat.

7. A nuclear reactor including a tertiary fluid and a tertiary fluid circulation system for heat exchangers having a shell portion, a first group of tubes through which a primary fluid flows, a second group of tubes through which a secondary fluid flows, said first and second groups of tubes being so positioned that a tube of one group is positioned between a plurality of tubes in the other group, and means for conducting heat positioned between said tubes, whereby a portion of the heat energy in the fluid in one group of tubes is transferred through said means for conducting heat to the fluid in the other group of tubes, said tertiary fluid circulation system comprising:

said shell having tertiary fluid inlet means and tertiary fluid outlet means;

said means for conducting heat having passageways from said tertiary fluid inlet means to said tertiary fluid outlet means;

means for connecting said tertiary fluid outlet means and said tertiary fluid inlet means, said connecting means including a turbine, said turbine producing useful energy and being cooperatively associated with means utilizing said energy to circulate said tertiary fluid from said tertiary fluid inlet means, through said passageways in said means for conducting heat, through said tertiary fluid outlet means, and back to said tertiary fluid inlet means.

8. A tertiary fluid circulation system for heat exchangers having a shell portion, a first group of tubes through which a primary fluid flows, a second group of tubes through which a secondary fluid flows, said first and second groups of tubes being so positioned that a tube of one group is positioned between a plurality of tubes in the other group, and means for conducting heat positioned between said tubes, whereby a portion of the heat energy in the fluid in one group of tubes is transferred through said means for conducting heat to the fluid in the other group of tubes, said tertiary fluid circulation system comprising:

said shell having tertiary fluid inlet means and tertiary fluid outlet means;

said means for conducting heat having passageways from said tertiary fluid inlet means to said tertiary fluid outlet means;

means for connecting said tertiary fluid outlet means and said tertiary fluid inlet means; and means for circulating a tertiary fluid from said tertiary fluid inlet means, through said passageways in said means for conducting heat, through said tertiary fluid outlet means, through said means for connecting said tertiary fluid outlet means and said tertiary fluid inlet means, and to said tertiary fluid inlet means, said tertiary fluid being a mixture of an inert gas and oxygen gas.

9. A tertiary fluid circulation system for heat exchangers having a shell portion, a first group of tubes through which a primary fluid flows, a second group of tubes through which a secondary fluid flows, said first and second groups of tubes being so positioned that a tube of one group is positioned between a plurality of tubes in the other group, and means for conducting heat positioned between said tubes, whereby a portion of the heat energy in the fluid in one group of tubes is transferred through said means for conducting heat to the fluid in the other group of tubes, said tertiary fluid circulation system comprising:

said shell having tertiary fluid inlet means and tertiary fluid outlet means;

said means for conducting heat having passageways from said tertiary fluid inlet means to said tertiary fluid outlet means;

means for connecting said tertiary fluid outlet means and said tertiary fluid inlet means; and means for circulating a tertiary fluid from said tertiary fluid inlet means, through said passageways in said means for conducting heat, through said tertiary fluid outlet means, through said means for connecting said tertiary fluid outlet means and said tertiary fluid inlet means, and to said tertiary fluid inlet means, said tertiary fluid being a mixture of an inert gas and hydrogen gas.

* * * * *